US011740043B1

(12) United States Patent
Cook et al.

(10) Patent No.: US 11,740,043 B1
(45) Date of Patent: Aug. 29, 2023

(54) GAS MANAGEMENT FOR FIREARMS

(71) Applicant: BROWNING, Morgan, UT (US)

(72) Inventors: Ryan D. Cook, Morgan, UT (US); Robert G. Maughan, Layton, UT (US); Marcus A. Heath, Farr West, UT (US)

(73) Assignee: BROWNING, Morgan, UT (US)

( * ) Notice: Subject to any disclaimer, the term of this patent is extended or adjusted under 35 U.S.C. 154(b) by 0 days.

(21) Appl. No.: 17/942,438

(22) Filed: Sep. 12, 2022

(51) Int. Cl.
*F41A 5/26* (2006.01)
*F41A 3/66* (2006.01)

(52) U.S. Cl.
CPC . *F41A 5/26* (2013.01); *F41A 3/66* (2013.01)

(58) Field of Classification Search
CPC ..... F41A 3/76; F41A 5/26; F41A 5/24; F41A 5/28; F41A 3/22
USPC ..... 89/26, 185
See application file for complete search history.

(56) References Cited

U.S. PATENT DOCUMENTS

| | | | | |
|---|---|---|---|---|
| 495,741 | A | 4/1893 | Krnka | |
| 579,994 | A | 4/1897 | Mauser | |
| 2,585,195 | A | 2/1952 | Walker | |
| 3,005,279 | A | 10/1961 | Brewer | |
| 3,710,492 | A * | 1/1973 | Tirrell | F41A 3/30 42/16 |
| 4,723,369 | A | 2/1988 | Badali | |

* cited by examiner

*Primary Examiner* — Reginald S Tillman, Jr.
(74) *Attorney, Agent, or Firm* — DORSEY & WHITNEY LLP

(57) ABSTRACT

A firearm can include a receiver, a bolt, and a gas block. In certain implementations, the receiver and/or barrel extension includes a locking shoulder, a lug-interface region forward of the locking shoulder, and a channel wall that defines a bolt channel and a bolt-lug raceway rearward of the locking shoulder. In some implementations, the bolt includes a bolt lug. The bolt lug can be sized and shaped to slidably engage the bolt-lug raceway. Additionally, the bolt can be positioned within the bolt channel of the receiver. Further, the gas block can be positioned at the lug-interface region. In some implementations, the gas block is rotatable with the bolt lug. In particular implementations, the gas block includes a raceway plug sized and shaped to block the bolt-lug raceway. The gas block can also include a bolt-lug notch sized and shaped to mate with the bolt lug.

20 Claims, 11 Drawing Sheets

GAS MANAGEMENT FOR FIREARMS

FIELD

The described embodiments relate generally to firearms (e.g., rifles). More particularly, the present embodiments relate to a gas block disposed inside of a firearm.

BACKGROUND

Firearms are designed to load a cartridge that typically includes a predetermined amount of gun powder positioned within a casing of the cartridge. In turn, firearms can be discharged by causing the gun powder to ignite and expel a bullet from the cartridge through a barrel. Firing pins and other components can be employed to cause ignition of the gun powder (e.g., in response to pulling a trigger mechanism). In particular, ignition of the gun powder causes an explosive-type of reaction. High pressure gasses form behind the bullet and cause the bullet to travel through the barrel. These high pressure gasses follow the bullet and then escape out the muzzle-end of the barrel.

Sometimes, high pressure gasses can travel toward a breech-end of the barrel (opposite of the muzzle-end). For instance, leaks or ruptures through a primer, a casing, or other portion of a cartridge can lend to such rearward gas flow. To this end, firearms typically include one or more mechanisms designed to handle, contain, or direct high pressure breech-end gasses. For example, venting ports, full-diameter bolt bodies, baffle lugs, or other gas management mechanisms can be implemented in conventional firearms to redirect or reduce gas flow traveling rearward (instead of forward toward a muzzle-end of a barrel). Unfortunately, such conventional implementations can provide various disadvantages. For example, gas-management mechanisms of conventional firearms can lead to increased bolt drag, heavier bolts, limited compatibility to feeding ramp configurations or bolt-extractor systems, errant orientations, decreased manufacturability, etc.

The subject matter claimed herein is not limited to embodiments that solve any disadvantages or that operate only in environments such as those described above. Rather, this background is only provided to illustrate one example technology area where some embodiments described herein may be practiced.

SUMMARY

An aspect of the present disclosure relates to a firearm. In some embodiments, the firearm includes a bolt and a gas block. In certain implementations, the firearm additionally includes a locking shoulder, a lug-interface region forward of the locking shoulder, and a channel wall that defines a bolt channel and a bolt-lug raceway. In some embodiments the bolt includes a bolt lug. Additionally, the bolt can be positioned within the bolt channel of the receiver. In certain embodiments, the bolt lug is sized and shaped to slidably engage the bolt-lug raceway. Further, the gas block can be positioned at the lug-interface region. In some embodiments, the gas block is rotatable with the bolt lug. In particular embodiments, the gas block includes a raceway plug sized and shaped to block the bolt-lug raceway. The gas block can also include a bolt-lug notch sized and shaped to engage the bolt lug.

In one or more embodiments, the firearm includes a barrel connected to the receiver, wherein the lug-interface region is rearward of the barrel. In certain embodiments, the gas block is rotatably constrained at the lug-interface region. The gas block can further include a first face positioned proximate to the barrel, and a second face opposing the first face. In one or more embodiments, the second face is positioned proximate to or abuts the locking shoulder. Additionally, in some embodiments, the raceway plug is positioned on the second face.

The gas block can further include an annular exterior portion substantially perpendicular to the first face and the second face, and a bolt-interface portion defining a thru-hole between the first face and the second face, the bolt-lug notch, the raceway plug, and an extractor relief cutout.

In some embodiments, the bolt-lug notch is oriented toward the bolt-lug raceway for receiving the bolt lug during a first cycling stage. Further, in some embodiments, the bolt-lug notch is oriented toward the locking shoulder upon completion of a second cycling stage. Additionally, in one or more embodiments, the raceway plug is oriented toward the locking shoulder during a first cycling stage. Furthermore, in one or more embodiments, the raceway plug is oriented toward the bolt-lug raceway upon completion of a second cycling stage. In certain implementations, upon completion of the second cycling stage, the raceway plug forms at least a partial hermetical seal of the bolt-lug raceway. In some embodiments, the gas block substantially fills a volumetric void defined by the lug-interface region.

Another aspect of the present disclosure relates to a method of cycling a firearm. The method can include providing a bolt, a gas block, a receiver, and a barrel connected to the receiver. In addition, the method can include sliding, during a first cycling stage, the bolt through the receiver toward the barrel, the bolt comprising a bolt lug, and the receiver comprising a locking shoulder. Further, the method can include rotating, during a second cycling stage, the bolt into a firing position upon the bolt reaching a lug-interface plane where a rear face of the bolt lug aligns flush with a front face of the locking shoulder. In one or more embodiments, rotating the bolt simultaneously rotates the gas block into a gas-blocking position. Further, in some embodiments, the gas-blocking position of the gas block substantially preventing gas rearward of the lug-interface plane.

In particular embodiments, the receiver includes a bolt-lug raceway. Additionally, sliding, during the first cycling stage, the bolt through the receiver includes sliding the bolt lug forward exclusively in an axial direction along the bolt-lug raceway until a front face of the bolt lug is positioned adjacent to the barrel. In some embodiments, sliding, during the first cycling stage, the bolt through the receiver comprises sliding at least a portion of the bolt completely through the gas block. In one or more embodiments, the method further includes mating the bolt lug and the gas block upon completion of the first cycling stage.

In one or more embodiments, upon completion of the first cycling stage: the gas block includes an abutment face that can contact the front face of the locking shoulder at the lug-interface plane, the abutment face comprising a raceway plug; and mating the bolt lug and the gas block comprises aligning the rear face of the bolt lug flush with the abutment face of the gas block. In certain embodiments, rotating, during the second cycling stage, the bolt into the firing position includes: maintaining an approximate axial position of the bolt within the receiver; and rotating the gas block into the gas-blocking position by rotating the bolt lug and the gas block until the raceway plug axially blocks at least part of a raceway portion of the receiver rearward of the lug-interface plane.

Yet another aspect of the present disclosure includes a gas ring insert for a firearm. The gas ring insert includes: a first face and a second face opposing the first face, an annular exterior portion, and a bolt-interface interior portion. In some embodiments, the first face includes a shoulder-interface portion. The annular exterior portion can be substantially perpendicular to the first face and the second face. Additionally, the bolt-interface interior portion can consist of a thru-hole between the first face and the second face, a bolt-lug notch, and an extractor relief cutout.

In some embodiments, the second face includes a barrel-facing portion. Additionally, in some embodiments, the shoulder-interface portion comprises a raceway plug. Further, in some embodiments, the annular exterior portion defines a recess sized and shaped to engage a detent.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1:
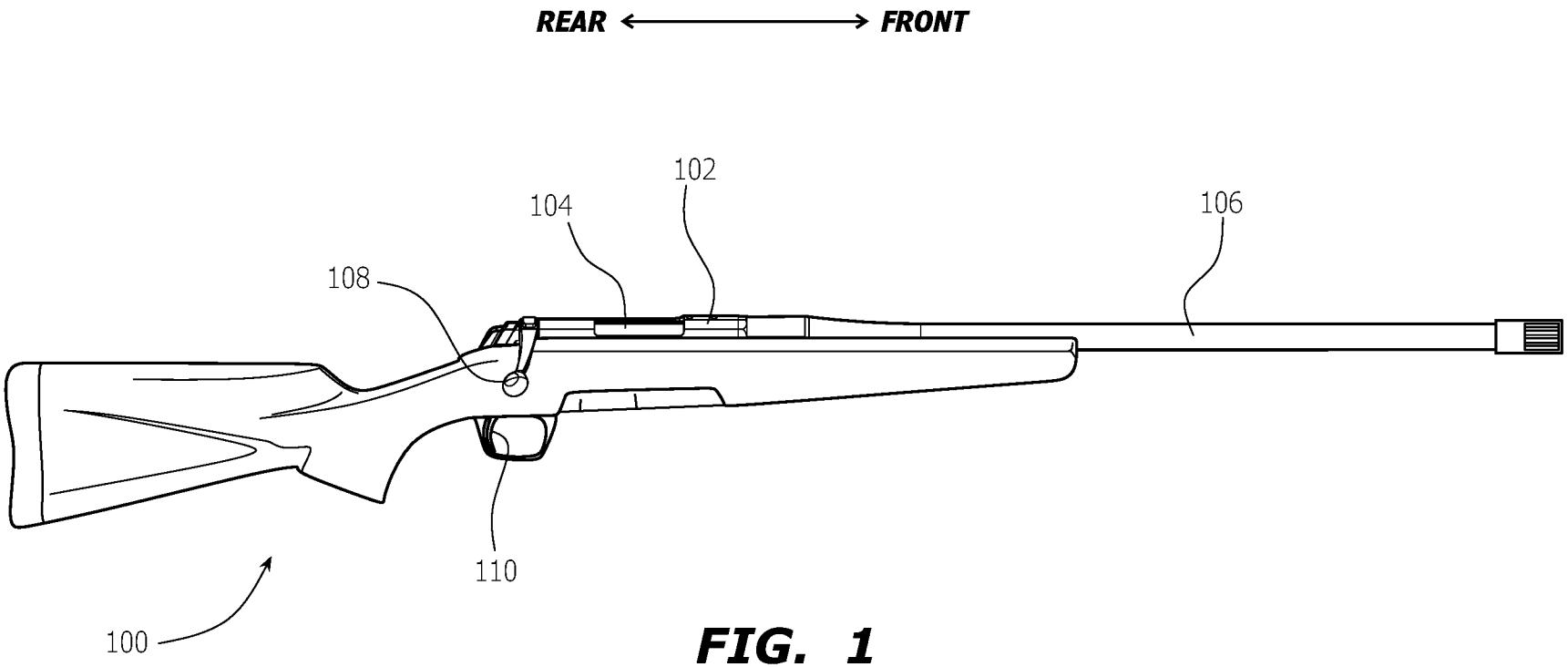
FIG. 1 illustrates a side view of an example firearm.

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

The following disclosure relates to a gas block for a firearm. In one example, the gas block includes a structural ring located at a lug interface region between the breech end of a barrel and a locking shoulder. In particular embodiments, the gas block is sized and shaped to mate (e.g., interlock) with a bolt at certain bolt positions. Specifically, the gas block comprises cutouts for at least partially enveloping a bolt lug (or multiple bolt lugs) during opening and closing stages of cycling a bolt. Upon mating with the bolt lug, the gas block can be rotated together with the bolt lug. For instance, upon rotating to a locked (or firing) position, the bolt lug abuts the locking shoulder at a lug-interface plane to secure the bolt in place. Further, once rotated to the locked (or firing) position, the gas block can prevent or reduce gas flow rearward of the lug-interface plane through a receiver raceway, which was previously occupied by the bolt lug before the rotation.

These and other embodiments of the disclosed gas block can provide a number of advantages over conventional gas management mechanisms. Specifically, the gas block includes a raceway plug positionally offset from the bolt lug such that the raceway plug rotates into a gas-blocking position forward of the receiver raceway as the bolt lug rotates away from the receiver raceway and into a locked, firing position.

As another example, the seating position of the gas block against the lug-interface plane can avoid interference with (or dependence upon) specific firearm designs, such as particular feeding ramp configurations, relief features, bolt diameters, etc. The disclosed gas block can therefore provide improved compatibility with myriad different types of bolts (including full-body-diameter bolts, multi-caliber bolts, various bolt-lug counts, etc.).

In addition, the disclosed gas block can fill a volumetric void within the receiver at a lug-interface region. The gas block can reduce the amount of receiver surface area exposable to high pressure gasses, therefore reducing an amount of force capable of being applied to the receiver.

Still further, the disclosed gas block can avoid the obtrusive approaches of some conventional gas management mechanisms. In particular, the gas block of the present disclosure is an independent component separate from the bolt. Therefore, the gas block does not impart increased drag during cycling of the bolt (e.g., as with integrally connected baffle lugs that engage the receiver as a bolt slides through a receiver).

Additionally, the disclosed gas block can provide smooth rotation between indexed positions. These indexed positions can include an unlocked position for bolt lug entrance into and exit from the gas block. In addition, the indexed positions can include a locked (or firing) position where the bolt lug is fully secured inside the gas block. The locked (or firing) position also corresponds to a gas-blocking position where the raceway plug of the gas block aligns with and blocks access to a raceway of the receiver. In at least some embodiments, the gas block includes a recess and corresponding detent that fixes the rotation range of motion and helps prevent errant orientation or misalignment of the gas block relative to the bolt lug.

These and other embodiments are discussed below with reference to FIGS. 1-9B. However, those of ordinary skill in the art will readily appreciate that the detailed description given herein with respect to the FIGS. is for explanatory purposes only and should not be construed as limiting. Furthermore, as used herein, a system, a method, an article, a component, a feature, or a sub-feature including at least one of a first option, a second option, or a third option should be understood as referring to a system, a method, an article, a component, a feature, or a sub-feature that can include one of each listed option (e.g., only one of the first option, only one of the second option, or only one of the third option), multiple of a single listed option (e.g., two or more of the first option), two options simultaneously (e.g., one of the first option and one of the second option), or combination thereof (e.g., two of the first option and one of the second option).

FIG. 1 illustrates an example of a firearm 100 in accordance with one or more embodiments of the present disclosure. As used herein, the term "firearm" refers to any device configured to expel a projectile by way of an explosive element. In particular, a firearm includes a firing mechanism, such as a breech-loading firearm. Specific implementations of a firearm include bolt-action rifles. However, other implementations of a firearm are also herein contemplated, including firearms with different types of actions or cartridge cycling mechanisms. For instance, the firearm 100 can use gas, blow-forward, blowback or recoil energy to eject a case or chamber a cartridge (as done in some semi-automatic actions).

As shown, the firearm 100 includes a receiver 102, a bolt 104, a barrel 106, a bolt handle 108, and a trigger mechanism 110. The receiver 102 includes a frame portion of the firearm 100. The receiver 102 houses action components for breech loading, locking, firing, extracting, and ejecting an ammunition cartridge (hereafter "cartridge"). In particular embodiments, the receiver 102 houses components for a bolt-action, such as the bolt 104.

In one or more embodiments, the bolt 104 comprises elements for cycling a cartridge into a chamber of the barrel 106. For example, the bolt 104 can catch and guide a cartridge from a magazine into the chamber of the barrel 106. Further, the bolt 104 can seal off the rear (breech-end) portion of the barrel 106 for discharging the firearm 100. In this sealed-off firing position, the bolt 104 can support an applied axial load from recoil at the time of discharge. In addition, the bolt 104 can include one or more firing mechanisms, such as a firing pin that engages a primer portion of the cartridge. The bolt 104 can also include an extractor that hooks onto a rim of the cartridge case for pulling it out of the chamber of the barrel 106. An ejector of the bolt 104 can then push the cartridge case out of an ejection port in the receiver 102. The bolt 104 can include a myriad of different types and sizes of bolts, including full-body diameter bolts. As will be discussed below in relation to subsequent figures, the firearm 100 includes a gas block (not shown in FIG. 1) that engages the bolt 104.

The firearm 100 further includes the barrel 106. The barrel 106 is connected to the receiver 102. In one or more embodiments, the barrel 106 receives a cartridge at a rearward portion. Once the firearm 100 is fired, a bullet is expelled out of the front portion (muzzle-end) of the barrel 106. Often, the barrel 106 includes internal grooves spiraled to impart various aerodynamic attributes of the bullet. In certain implementations, the barrel 106 includes various attachments, such as a muzzle-break, suppressor, etc.

Additionally shown in FIG. 1, the firearm 100 includes a handle 108. The handle 108 is attached to the bolt 104 (e.g., for manually cycling the bolt 104 between locked and unlocked positions as will be discussed more below). The handle 108 can be positioned or oriented differently than illustrated (e.g., for left-handed users, various bolt-lift angles, etc.).

The firearm 100 further includes the trigger mechanism 110. Via the trigger mechanism 110, the firearm 100 can cause the firing pin of the bolt 104 to press into the primer of the cartridge for igniting the gun powder and explosively expelling a bullet through the barrel 106.

Any of the features, components, and/or parts, including the arrangements and configurations thereof shown in FIG. 1 can be included, either alone or in any combination, in any of the other examples of devices, features, components, and parts shown in the other figures described herein. Likewise, any of the features, components, and/or parts, including the arrangements and configurations thereof shown and described with reference to the other figures can be included, either alone or in any combination, in the example of the devices, features, components, and parts shown in FIG. 1.

Figure 2:
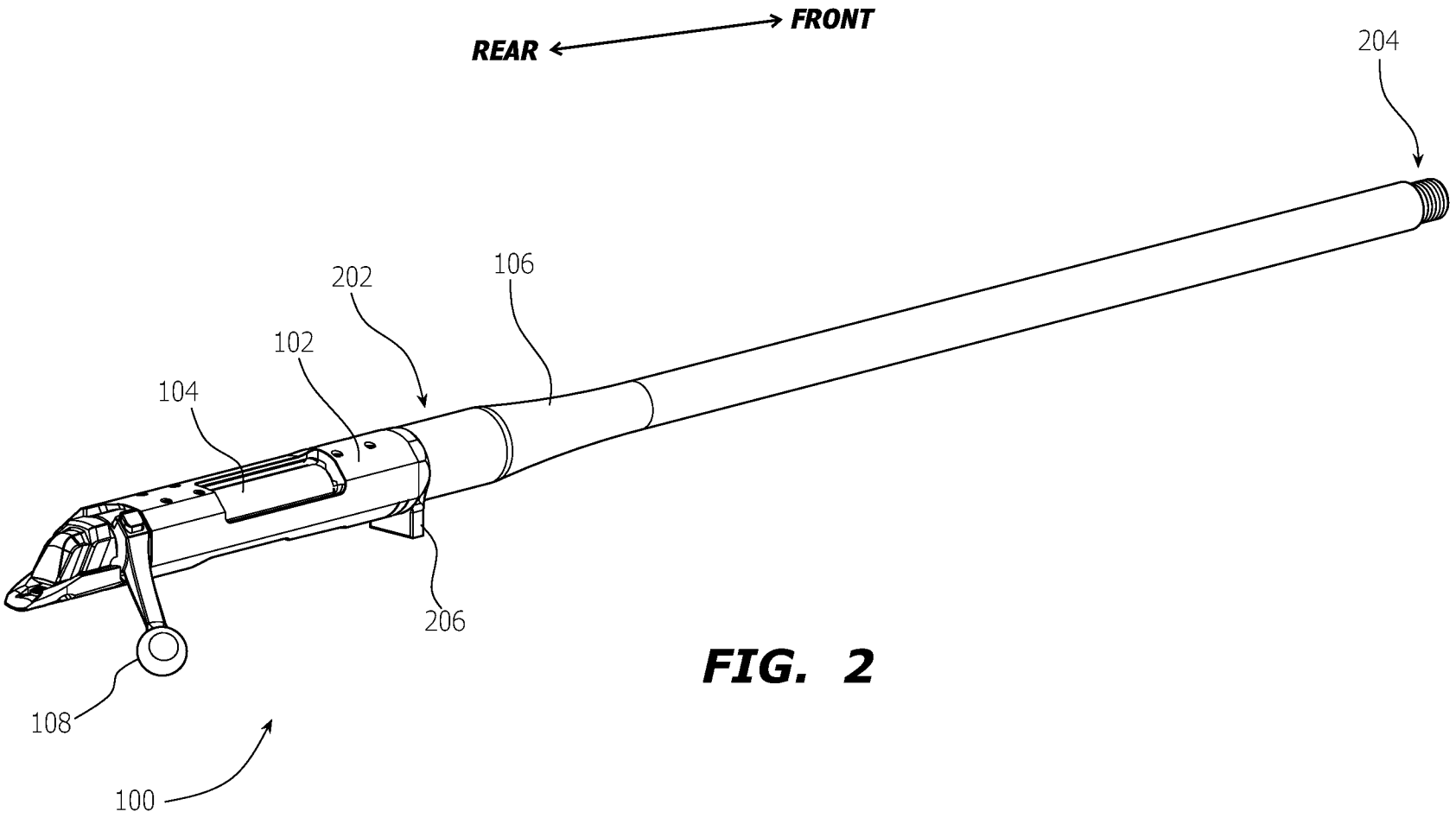
FIG. 2 illustrates a perspective view of an example firearm subassembly.

FIG. 2 illustrates a firearm subassembly 200 in accordance with one or more embodiments of the present disclosure. As shown, the firearm subassembly 200 includes the receiver 102, the bolt 104, the barrel 106, and the handle 108 discussed above. The firearm subassembly 200 further includes a recoil lug 206 positioned between the receiver 102 and a breech-end 202 of the barrel 106 (opposite of a muzzle-end 204).

With various portions of the firearm 100 not shown in FIG. 2, the firearm subassembly 200 shows a more focused view of where a gas block (not shown in FIG. 2) of the present disclosure can be implemented. Indeed, the gas block as disclosed herein can be implemented rearward of the breech-end 202 of the barrel 106 and rearward of the recoil lug 206. In particular, the gas block can be implemented in a front portion of the receiver 102—namely a lug-interface region adjacent to internal locking shoulders of the receiver 102 (as will be discussed below). Other positional configurations of the gas block are also herein contemplated.

Any of the features, components, and/or parts, including the arrangements and configurations thereof shown in FIG. 2 can be included, either alone or in any combination, in any of the other examples of devices, features, components, and parts shown in the other figures described herein. Likewise, any of the features, components, and/or parts, including the arrangements and configurations thereof shown and described with reference to the other figures can be included, either alone or in any combination, in the example of the devices, features, components, and parts shown in FIG. 2.

Figure 3:
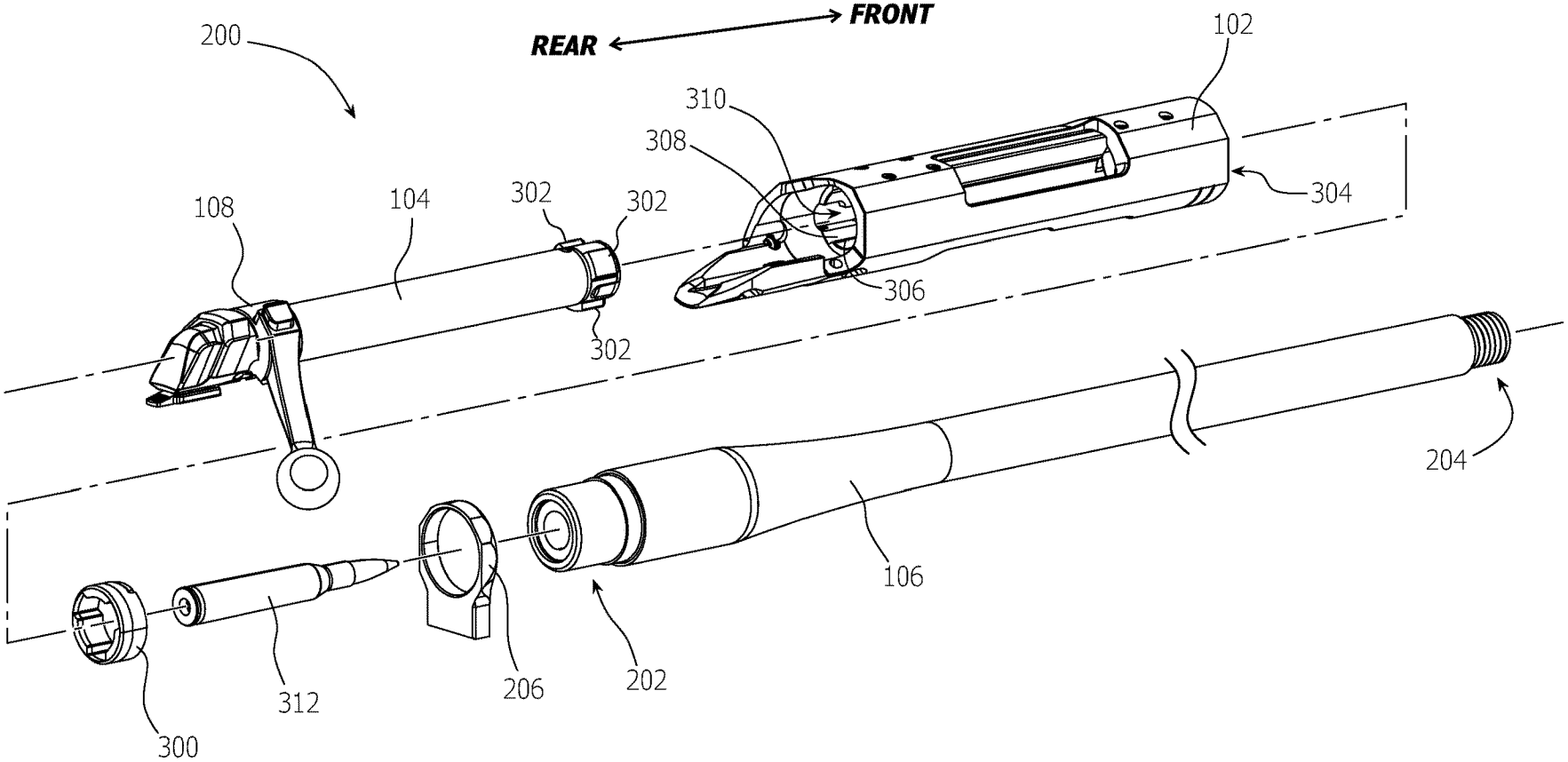
FIG. 3 illustrates an exploded view of an example firearm subassembly.

FIG. 3 illustrates an exploded view of the firearm subassembly 200 in accordance with one or more embodiments of the present disclosure. As shown, the firearm subassembly 200 includes a gas block 300. Those skilled in the art will appreciate that the term "gas block" of the present disclosure refers to structure, not function. Indeed, a gas block can include structure to completely seal off or block gas flow in a predetermined direction. However, in other implementations, a gas block can include structure to partially seal, block, or inhibit gas (but not do so entirely). In these or other embodiments, a gas block can reduce gas flow, redirect gas flow, slow gas flow velocity, etc. Accordingly, a gas block of the present disclosure is not limited to specific functionality.

Figure 6A:
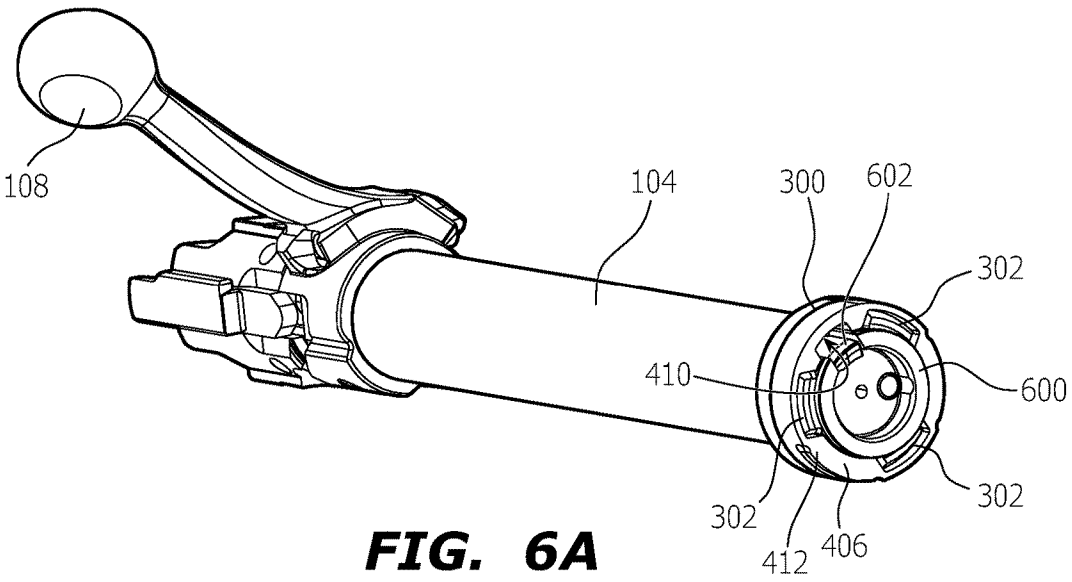
FIGS. 6A-6B illustrate front and rear perspective views of an example bolt engaging an example gas block.
Figure 6B:
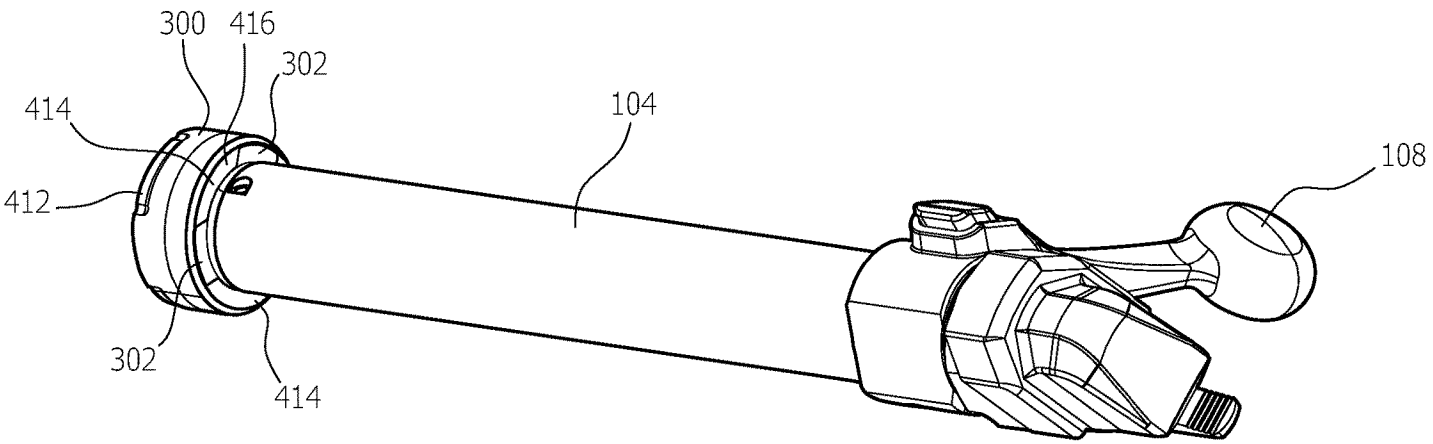

In one or more embodiments, the gas block 300 comprises an independent, rotatable insert positioned between locking shoulders 304 and the breech-end 202 of the barrel 106. The gas block 300 can engage the bolt 104. In particular, the gas block 300 is sized and shaped to mate with (and rotate with) bolt lugs 302 of the bolt 104. For instance, the gas block 300 can interlock with the bolt lugs 302 when the bolt 104 is inserted into a bolt channel 310—and specifically when the bolt lugs 302 are forward of the locking shoulders 304 (as shown in FIGS. 6B-6C). In certain orientations, the gas block 300 can also provide gas-blocking capabilities. Subsequent figures will describe the gas block 300 in greater detail.

Although the locking shoulders 304 are shown as part of the receiver 102, those skilled in the art will appreciate that the locking shoulders 304 can be implemented in other parts of a firearm. For example, the locking shoulders 304 can be implemented in a barrel extension (not shown) that is positioned between the receiver 102 and the breech-end 202 of the barrel 106.

Further shown in FIG. 3, the receiver 102 includes a channel wall 306. The channel wall 306 defines bolt-lug raceways 308 and a bolt channel 310. In some embodiments, the bolt-lug raceways 308 and the bolt channel 310 extend an entire distance from a rear portion to a front portion of the receiver 102. In certain embodiments, the bolt lug raceways 308 and the bolt channel 310 extend through a portion of the receiver 102. For instance, the bolt-lug raceways 308 and the bolt channel 310 extend rearward of the locking shoulders 304. In some embodiments, the bolt-lug raceways 308 and the bolt-channel 310 also extend forward of the locking shoulders 304, for instance, into a lug-interface region.

The bolt-lug raceways 308 include one or more grooves for the bolt lugs 302 to slidably engage the interior portion of the receiver 102. In certain implementations, the bolt-lug raceway 308 are sized and shaped according to the bolt lugs 302. In this manner, the bolt-lug raceways 308 can help maintain an orientation of the bolt 104 as the bolt 104 moves through the receiver 102. In some instances, maintaining an orientation of the bolt 104 through the receiver 102 can be advantageous for aligning the bolt lugs 302 and the gas block 300. Similarly, the bolt channel 310 comprises a thru-hole in which the bolt 104 can slide through the interior portion of the receiver 102 (e.g., when cycling the bolt between locked and unlocked positions). Indeed, the bolt 104 can be removably positioned from the bolt channel 310 of the receiver 102. In one or more embodiments, the bolt channel 310 is sized and shaped according to the bolt 104 (e.g., to correspond to an outer diameter of the bolt 104).

FIG. 3 further illustrates a cartridge 312. In one or more embodiments, the cartridge 312 is pushed into the breech end 202 of the barrel 106 during loading. Once loaded, a bullet from the cartridge 312 can be expelled from the barrel 106 at the muzzle end 204. The bolt 104 can then extract the spent cartridge.

One of ordinary skill in the art will appreciate that portions of the cartridge 312 can include a size or dimension that corresponds to the receiver 102, the bolt 104, the barrel 106, and/or other components of the firearm subassembly 200. Indeed, the receiver 102, the bolt 104, the barrel 106, and/or other components of the firearm subassembly 200 can be designed for a particular cartridge. In other embodiments, the receiver 102, the bolt 104, the barrel 106, and/or other components of the firearm subassembly 200 can be designed for multiple different cartridges. The cartridge 312 can include various components, such as a primer, casing, powder, etc.

Any of the features, components, and/or parts, including the arrangements and configurations thereof shown in FIG. 3 can be included, either alone or in any combination, in any of the other examples of devices, features, components, and parts shown in the other figures described herein. Likewise, any of the features, components, and/or parts, including the arrangements and configurations thereof shown and described with reference to the other figures can be included, either alone or in any combination, in the example of the devices, features, components, and parts shown in FIG. 3.

Figure 4A:
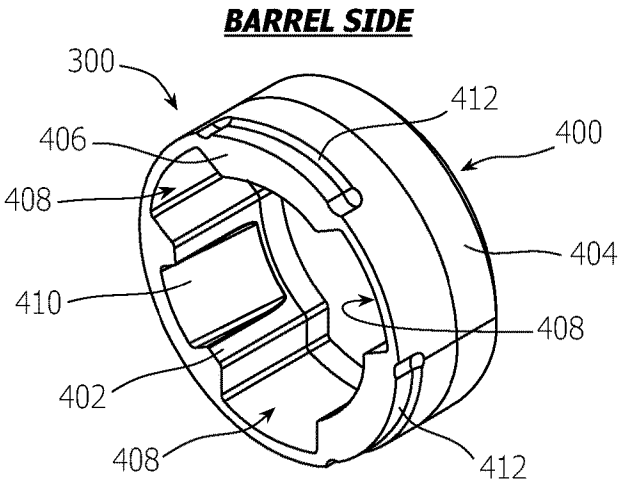
FIGS. 4A-4D illustrate perspective views of an example gas block.
Figure 4B:
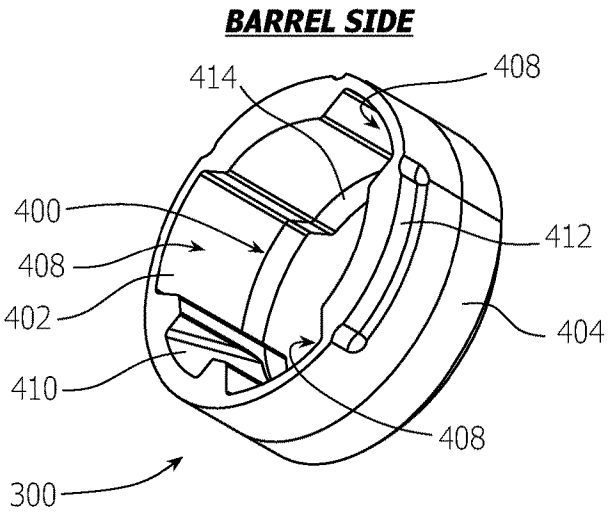
Figure 4C:
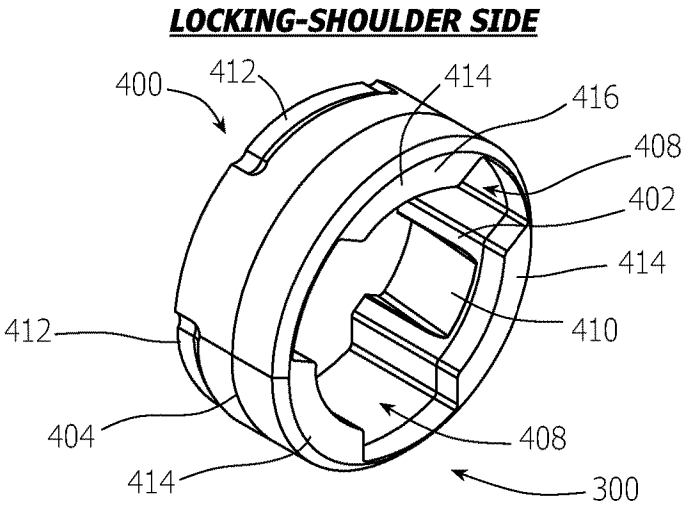
Figure 4D:
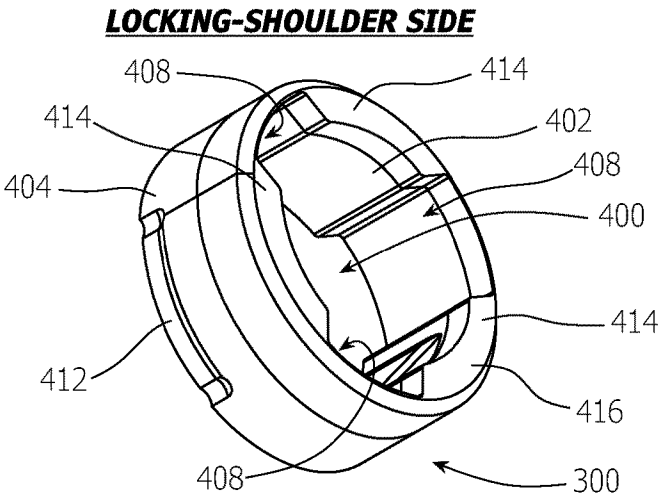
Figure 5A:
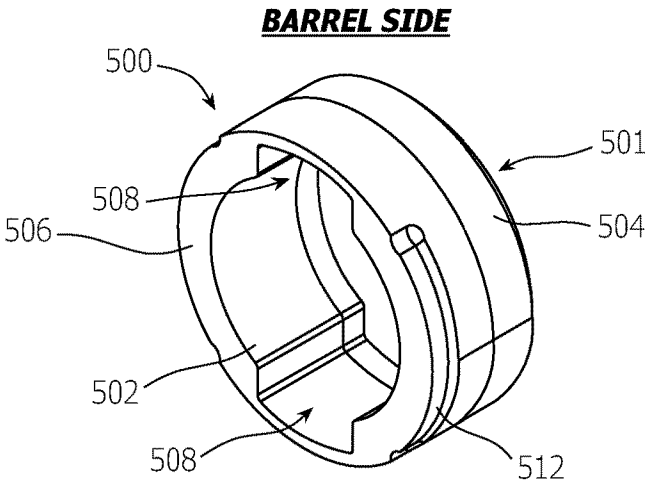
FIGS. 5A-5D illustrate perspective views of another example gas block.
Figure 5B:
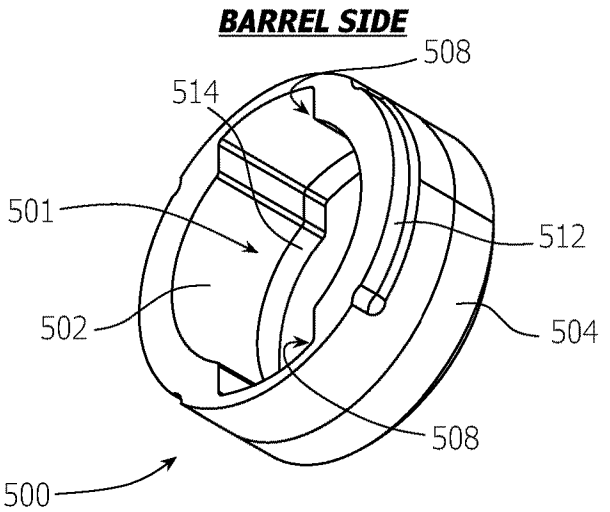
Figure 5C:
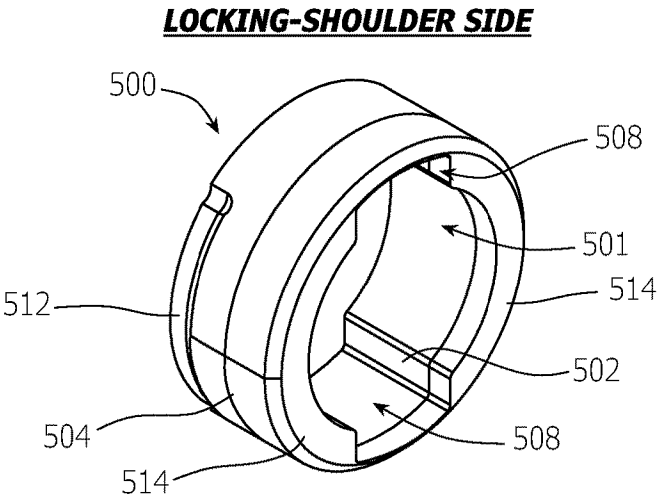
Figure 5D:
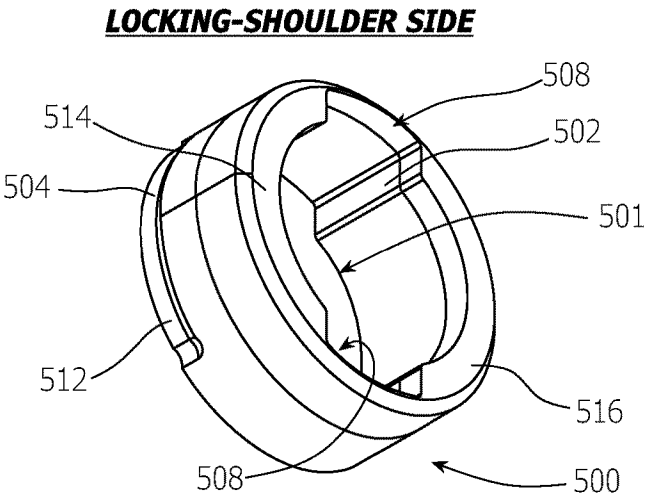

FIGS. 4A-4D illustrate perspective views of the gas block 300 in accordance with one or more embodiments of the present disclosure. In particular, FIGS. 4A-4B depict a barrel side of the gas block 300, and FIGS. 4C-4D depict a receiver-shoulder side of the gas block 300. As shown, the gas block 300 is depicted as a gas-ring insert for firearms. For example, as a gas-ring insert, the gas block 300 can be a separate, individual component for assembly and use in relation to other firearm components. Indeed, some portions of the gas block 300 interface with the receiver 102, the bolt 104, and/or the barrel 106. To illustrate, the gas block 300 includes a bolt-interface interior portion 402 that engages various portions of the bolt 104. In addition, the gas block 300 includes an annular exterior portion 404 positioned proximate to the receiver 102 (e.g., the inner diameter of the receiver 102). Further, the gas block 300 includes a barrel-facing portion 406 that can be positioned proximate to the breech-end 202 of the barrel 106. In addition, the gas block 300 includes a shoulder-interface portion 416 that can abut the locking shoulders 304.

In more detail, the barrel-facing portion 406 opposes the shoulder-interface portion 416. For example, the barrel-facing portion 406 and the shoulder-interface portion 416 include parallel (or substantially parallel) sides or faces of the gas block 300. In particular, the barrel-facing portion 406 can be positioned proximate to the barrel 106. In some cases, the barrel-facing portion 406 is in intimate contact with the barrel 106. However, the gas block 300 has some looseness or play, thereby allowing rotation of the gas block 300. Thus, the term "proximate" in the positional context of the gas block 300 refers to about a few micron to several dozen millimeters of separation from an adjacent component.

Further, the shoulder-interface portion 416 can be positioned proximate to the locking shoulders 304 (e.g., within a few micron to several millimeters of separation). In particular embodiments (especially in the event of rearward gas flow pushing against the gas block 300), the shoulder-interface portion 416 is flush and in intimate contact with the locking shoulders 304 along a lug-interface plane discussed more below. In addition, the barrel-facing portion 406 and the shoulder-interface portion 416 define a thru-hole 400 extending there between. The thru-hole 400, as a female type of connection, is sized and shaped to receive the bolt 104. The thru-hole 400 can include a cylindrical thru-hole (as shown). Alternatively, the thru-hole 400 can include different shaped thru-holes (e.g., square, triangular, etc.).

The bolt-interface interior portion 402 includes a variety of different elements. For example, the bolt-interface interior portion 402 includes bolt-lug notches 408 (e.g., three in total, one for each corresponding bolt lug of the bolt 104). The bolt-lug notches 408 are sized and shaped to rotatably engage the bolt lugs 302 of the bolt 104. That is, the bolt-lug notches 408 can include a curvature or fitted receptacle that intermeshes with the bolt lugs 302 in an interlocking fashion (e.g., in a male-female connection).

In one or more embodiments, the bolt-lug notches 408 are oriented in a particular way during specific cycling stages (e.g., specific positions of the bolt 104). To illustrate, the bolt-lug notches 408 are oriented (e.g., rotated) toward the bolt-lug raceways 308 for receiving the bolt lugs 302 during a first cycling stage. As another example, the bolt-lug notches 408 are oriented toward the locking shoulders 304 upon completion of a second cycling stage. The different rotational orientations of the gas block 300 at different cycling stages are discussed further below in relation to FIGS. 6A-6B.

In addition, the bolt-interface interior portion 402 includes an extractor relief cutout 410. The extractor relief cutout 410 includes a slot or recess within the bolt-interface interior portion 402. In particular, the extractor relief cutout 410 allows room for an extractor of the bolt 104 to pivot and engage a rim portion of the cartridge 312. Thus, in some embodiments, the extractor relief cutout 410 includes a varied depth between the barrel side and the receiver-shoulder side of the gas block 300 (e.g., allowing for greater displacement of an extractor portion adjacent to the barrel side of the gas block 300). In one or more embodiments, the extractor relief cutout 410 is positioned within raceway plugs 414 inside the bolt-interface interior portion 402. In certain implementations, the extractor relief cutout 410 extends only part-way from the barrel-facing portion 406 toward the shoulder-interface portion 416 (e.g., to help prevent incidental rearward gas flow).

As just mentioned, the bolt-interface interior portion 402 can include the raceway plugs 414 extending from the shoulder-interface portion 416. The raceway plugs 414 are sized and shaped to correspond to the bolt-lug raceways 308. In particular embodiments, the raceway plugs 414 are positioned in between the bolt-lug notches 408 (e.g., at the 2 o'clock, 6 o'clock, and 10 o'clock positions). Other positional configurations of the raceway plugs 414 are also herein contemplated. For instance, the raceway plugs 414 can be equally sized, thereby providing equidistant gas flow inhibition between the bolt-lug notches 408. In other instances, the raceway plugs 414 can be sized differently from each other, thereby providing different sizes of gas flow inhibition seal between the bolt-lug notches 408.

The raceway plugs 414 can also be oriented in a particular way during specific cycling stages (e.g., specific positions of the bolt 104). For example, the raceway plugs 414 are oriented toward the locking shoulders 304 during a first cycling stage (e.g., when the bolt lugs 302 are rearward of the locking shoulders 304). As another example, the raceway plugs 414 are oriented toward the bolt-lug raceways 308 in a gas-blocking position upon completion of a second cycling stage (e.g., when the bolt lugs 302 are locked and forward of the locking shoulders 304). Upon completion of the second cycling stage, the raceway plugs 414 can form at least a partial hermetical seal of the bolt-lug raceways 308 (as discussed more below in relation to FIGS. 6B-6C). In this manner, the raceway plugs 414 can help reduce or eliminate gas flow rearward of the locking shoulders 304.

In some embodiments, the raceway plugs 414 extend an entire distance from the shoulder-interface portion 416 to the barrel-facing portion 406 (e.g., as shown in FIGS. 4A-4D). In other embodiments, however, the raceway plugs 414 extend from the shoulder-interface portion 416 and stop short of the barrel-facing portion 406. Still, in other embodiments, the raceway plugs 414 can be cored-out (e.g., to reduce material consumption). For example, the raceway plugs 414 can be cored-out from the barrel side at the barrel-facing portion 406.

Additionally shown in FIGS. 4A-4D, the gas block 300 includes the annular exterior portion 404. In one or more embodiments, the annular exterior portion 404 is substantially perpendicular to the barrel-facing portion 406 and the shoulder-interface portion 416. The annular exterior portion 404 is also circular or cylindrical in shape. However, other outer surface shapes also fall within the scope of the present disclosure. For instance, the exterior portion can be block shaped, triangular shaped, oval shaped, etc. to correspond to a corresponding internal volume defined by the interior portion of the receiver 102 forward of the locking shoulders 304.

Additionally, in certain implementations, the annular exterior portion 404 defines a recess 412. In particular embodiments, the recess 412 is sized and shaped to engage a detent (not shown). The detent can bound or index the rotational range of motion of the gas block 300 (e.g., between locked and unlocked positions of the bolt 104). For example, a first end of the recess 412 corresponds to the gas block 300 in an unlocked position for allowing entrance or exit of the bolt 104 into the gas block 300. As another example, a second end of the recess 412 corresponds to the gas block 300 in a locked or gas-blocking position where the raceway plugs 414 axially block gas flow into the bolt-lug raceways 308 rearward of the locking shoulders 304. In at least some embodiments, the detent and the recess 412 work together to maintain an indexed position to help prevent misalignment of the gas block 300 relative to the bolt 104.

Any of the features, components, and/or parts, including the arrangements and configurations thereof shown in FIGS. 4A-4D can be included, either alone or in any combination, in any of the other examples of devices, features, components, and parts shown in the other figures described herein. Likewise, any of the features, components, and/or parts, including the arrangements and configurations thereof shown and described with reference to the other figures can be included, either alone or in any combination, in the example of the devices, features, components, and parts shown in FIGS. 4A-4D.

As mentioned above, the bolt 104 can include various numbers of bolt lugs. In accordance with one or more such embodiments the present disclosure, FIGS. 5A-5D illustrate perspective views of a gas block 500 for engaging a bolt with two bolt lugs (as opposed to three bolt lugs). The gas block 500 includes the same or similar features as just described in FIGS. 4A-4D. In particular, the gas block 500 includes a thru-hole 501, a bolt-interface interior portion 502, an annular exterior portion 504, a barrel interface 506, bolt-lug notches 508, a recess 512, raceway plugs 514, and a shoulder-interface portion 516.

Different from the gas block 300, the gas block 500 includes raceway plugs 514 (two in total) positioned at opposing regions of the shoulder-interface portion 516 (e.g., a first raceway plug at the 3 o'clock position and a second raceway plug at the 9 o'clock position). Additionally, a first bolt-lug notch of the bolt-lug notches 508 is positioned in between the raceway plugs 514 (e.g., at the 12 o'clock position). Further, a second bolt-lug notch of the bolt-lug notches 508 is positioned between the raceway plugs 514 opposite the first bolt-lug notch (e.g., at the 6 o'clock position). In this manner, the bolt-lug notches 508 and the raceway plugs 514 can be positionally and/or dimensionally modified to accommodate a variety of different bolt lug configurations and bolt lug counts (including a single bolt lug configuration).

The gas block 500 can include other modifications, additions, or omissions to the gas block 300. For example, the gas block 500 does not include an extractor relief cutout.

Any of the features, components, and/or parts, including the arrangements and configurations thereof shown in FIGS. 5A-5D can be included, either alone or in any combination, in any of the other examples of devices, features, components, and parts shown in the other figures described herein. Likewise, any of the features, components, and/or parts, including the arrangements and configurations thereof shown and described with reference to the other figures can be included, either alone or in any combination, in the example of the devices, features, components, and parts shown in FIGS. 5A-5D.

As discussed above, the gas block of the present disclosure can be sized and shaped to engage bolt lugs of the bolt. In accordance with one or more such embodiments, FIGS. 6A-6B illustrate front and rear perspective views of an example of the bolt 104 engaging the gas block 300. Upon engaging the gas block 300 in the manner illustrated, the gas block 300 can rotate with the bolt lugs 302. For example, the gas block 300 can rotate with the bolt lugs 302 between locked and unlocked positions, as will be described below.

In particular, FIG. 6A shows a front face 600 of the bolt 104 extending through the gas block 300 and past the front face of the gas block 300 (i.e., the barrel-facing portion 406).

In some instances, the front face 600 of the bolt 104 can engage the barrel 106 (e.g., to seal a cartridge within the chamber of the barrel 106).

Additionally shown in FIG. 6A, the bolt 104 includes an extractor 602. The extractor 602 can hook onto a rim of a cartridge. To do so, the extractor 602 can pivot or flex relative to the bolt 104. The extractor relief cutout 410 allows the extractor 602 to pivot in this manner. After discharge of the firearm, the extractor 602 can then pull a spent cartridge out of the chamber of the barrel 106.

FIG. 6B shows rear face of the gas block 300 (i.e., the shoulder-interface portion 416) being approximately flush with a rear face of the bolt lugs 302. Here, the term "approximately" refers to a positional tolerance in the range of about +/−25 millimeters (albeit tighter tolerances are herein contemplated). The shoulder-interface portion 416 coincides with the lug-interface plane (also described below). Therefore, alignment of the rear face of the bolt lugs 302 with the shoulder-interface portion 416 constitutes alignment of the bolt lugs 302 with the lug-interface plane.

When the rear face of the bolt lugs 302 is aligned with the shoulder-interface portion 416, the bolt 104 can be rotated. That is, within the gas block 300, the bolt lugs 302 can be rotated to engage (or disengage) the locking shoulders 304 (not shown). In doing so, the gas block 300 simultaneously rotates with the bolt lugs 302 (e.g., to move the gas block 300 into or out of a gas-blocking position).

Those of ordinary skill in the art will appreciate that different orientations and rotation variations of the gas block 300 with the bolt 104 are within the scope of the present disclosure. For example, the gas block 300 and the bolt 104 can be configured in a first manner for right-side ejection, and configured in a second (different) manner for left-side ejection. To illustrate, the gas block 300 can be positioned for right-side ejection such that the recess 412 (and corresponding detent) allows clockwise rotation of the gas block 300 from an unlocked position to the locked (firing) position and counter-clockwise rotation of the gas block 300 from the locked position to the unlocked position. The various elements of the bolt 104 could similarly be implemented (e.g., with the handle 108, extractor 602, etc.) on the right-side.

By contrast, the gas block 300 can be positioned for left-side ejection such that the recess 412 (and corresponding detent) allows counter-clockwise rotation of the gas block 300 from an unlocked position to the locked (firing) position and clockwise rotation of the gas block 300 from the locked position to the unlocked position. Likewise, the elements of the bolt 104 can be similarly implemented (e.g., with the handle 108, extractor 602, etc.) on the left-side.

Any of the features, components, and/or parts, including the arrangements and configurations thereof shown in FIGS. 6A-6D can be included, either alone or in any combination, in any of the other examples of devices, features, components, and parts shown in the other figures described herein. Likewise, any of the features, components, and/or parts, including the arrangements and configurations thereof shown and described with reference to the other figures can be included, either alone or in any combination, in the example of the devices, features, components, and parts shown in FIGS. 6A-6D.

Figure 7B:
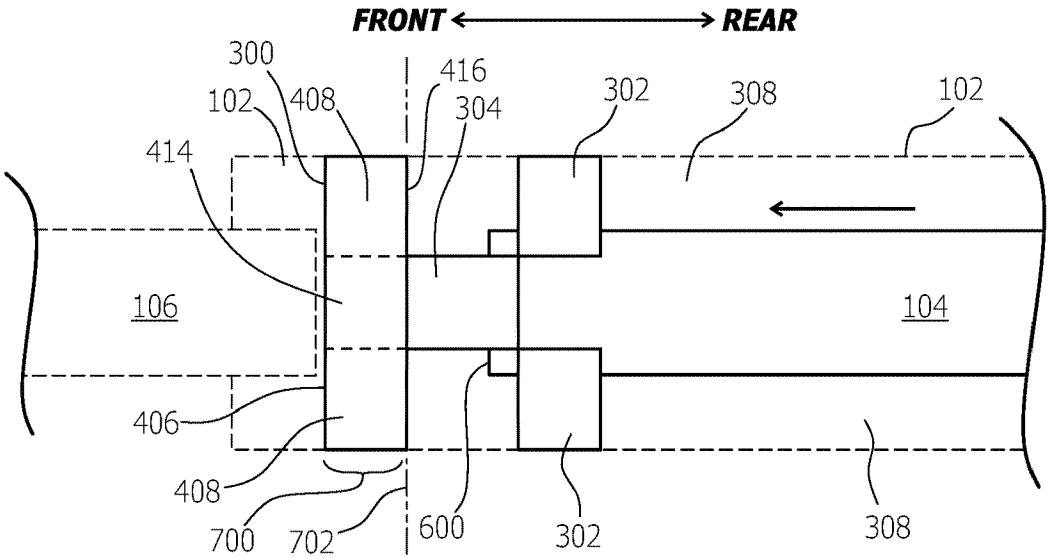
FIGS. 7A-7F illustrate perspective and side schematic views of an example bolt-cycling process with an example gas block.
Figure 7A:
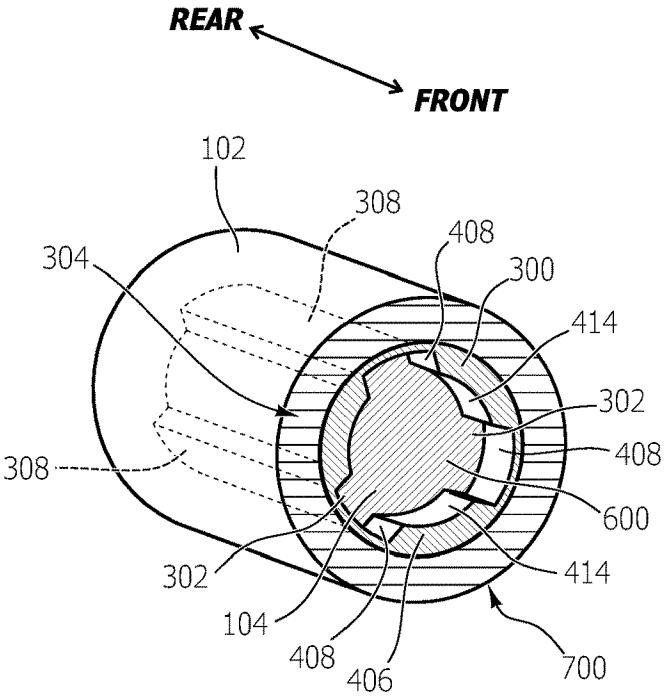
Figure 7D:
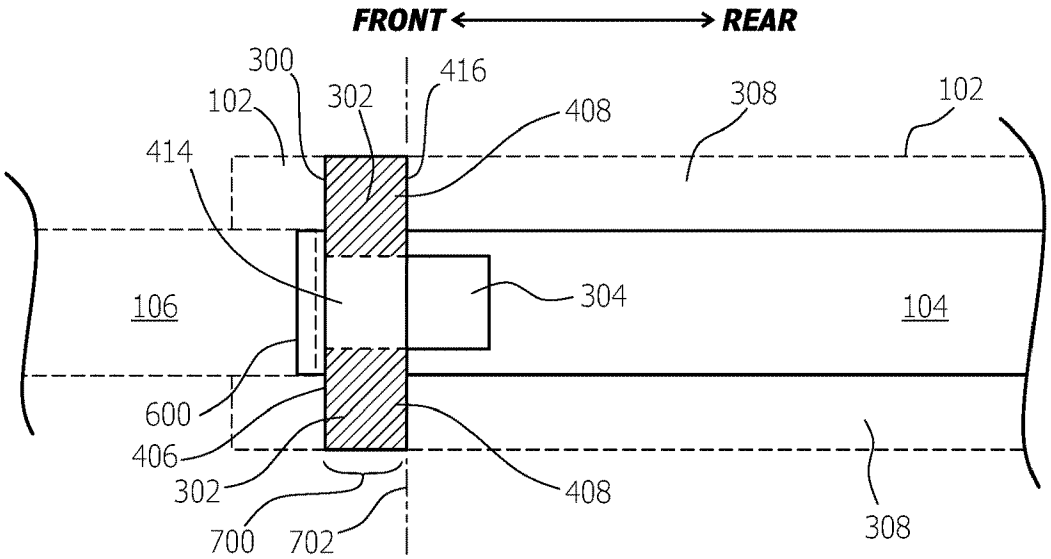
Figure 7C:
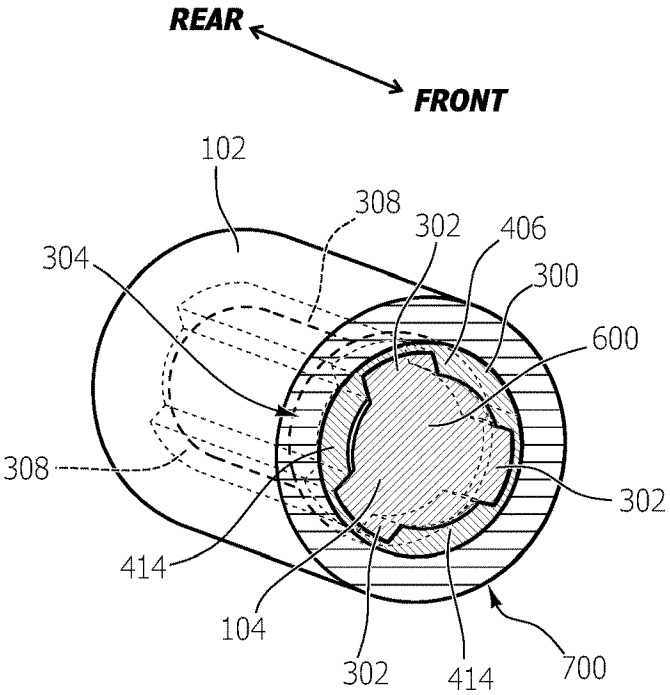
Figure 7F:
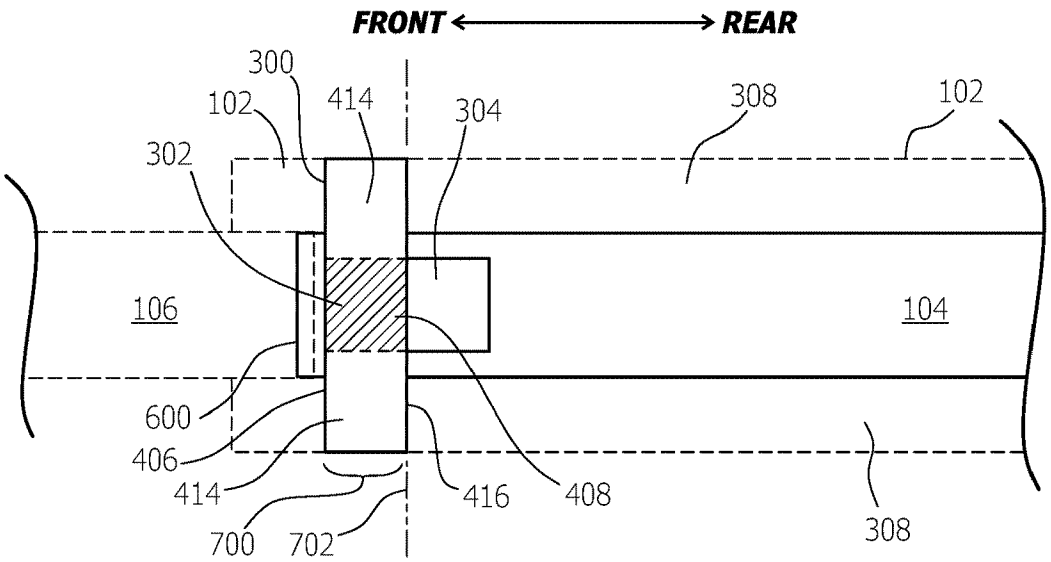
Figure 7E:
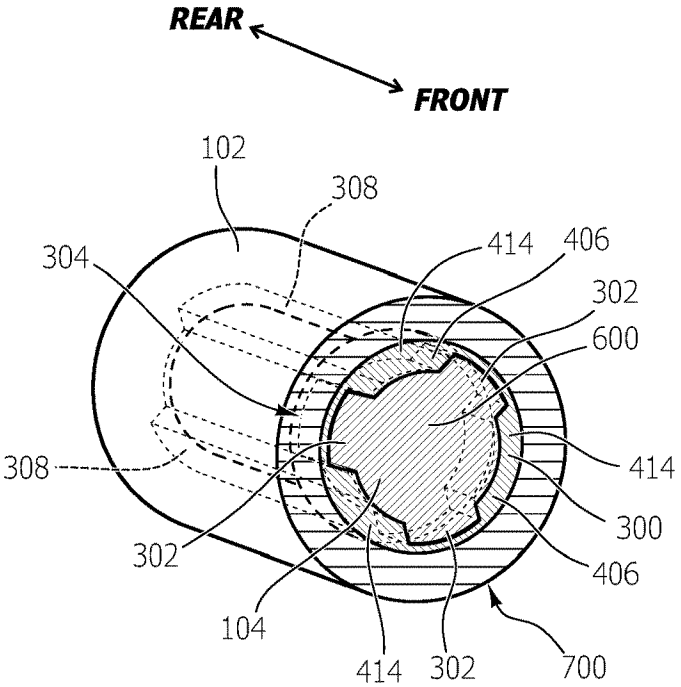

As mentioned above, the gas block 300 and the bolt 104 can be positioned in various different configurations at certain cycling stages. In accordance with one or more such embodiments, FIGS. 7A-7F illustrate various views of a bolt-cycling process with the gas block 300. FIGS. 7A-7B illustrate perspective and side schematic views at a certain point in a cycling stage. FIGS. 7C-7D illustrate perspective and side schematic views at another point in a cycling stage. FIGS. 7E-7F illustrate perspective and side schematic views at yet another point in a cycling stage. These pairs of figures are described in detail below.

In particular, FIGS. 7A-7B depict providing the bolt 104, the gas block 300, the receiver 102, and the barrel 106 connected to the receiver 102. Additionally, FIGS. 7A-7B show the bolt 104 sliding through the receiver 102 toward the barrel 106 during a first cycling stage. As the bolt 104 slides past the locking shoulders 304, the bolt lugs 302 are positionally offset from the locking shoulders 304. That is, the bolt lugs 302 are positioned within bolt-lug raceways 308.

Further shown in FIGS. 7A-7B, the front face 600 of the bolt 104 has not yet reached the gas block 300. Specifically, in the first cycling stage, the bolt lugs 302 approach a lug-interface region 700, where the gas block 300 is rotatably constrained. The lug-interface region 700 extends between front and rear portions of the gas block 300 (i.e., between the barrel-facing portion 406 and the shoulder-interface portion 416). In particular, the lug-interface region 700 extends forward of a lug-interface plane 702 and rearward of the barrel 106. The lug-interface plane 702 is where the locking shoulders 304 meet the shoulder-interface portion 416 and the rear faces of the bolt lugs 302. Thus, the lug-interface plane 702 is coplanar with one of a front end of the locking shoulders 304 or the shoulder-interface portion 416. In FIGS. 7A-7B, the lug-interface region 700 is devoid of the bolt 104.

While in the first cycling stage, the gas block 300 is positioned to receive the bolt 104. In particular, the bolt-lug notches 408 of the gas block 300 are aligned to receive the bolt lugs 302 of the bolt 104. In this position, the raceway plugs 414 of the gas block 300 are offset from the bolt lugs 302 such that the raceway plugs 414 do not inhibit the bolt lugs 302 from entering the bolt-lug notches 408. For example, the raceway plugs 414 are positioned in front of the locking shoulders 304 during the first cycling stage.

In at least some embodiments, the first cycling stage includes sliding the bolt 104 through the receiver 102 such that the bolt lugs 302 slide exclusively in an axial direction along the bolt-lug raceways 308. For example, the bolt lugs 302 slide along the bolt-lug raceways 308 exclusively in the axial direction until the front face 600 of the bolt 104 is in close proximity to the barrel 106 (as depicted in FIG. 7B).

In FIG. 7C-7D, the bolt 104 achieves completion of the first cycling stage. For example, the front face 600 of the bolt 104 extends completely through the gas block 300. In addition, the bolt lugs 302 are mated with the gas block 300. For instance, the bolt lugs 302 are positioned inside the bolt-lug notches 408.

Upon completion of the first cycling stage, FIG. 7C-7D show that the gas block 300 comprises an abutment face (i.e., the shoulder-interface portion 416) that can contact a front face of the locking shoulders 304 at the lug-interface plane 702. The rear faces of the bolt lugs 302 can also align flush with the shoulder-interface portion 416. Moreover, at the completion of the first cycling stage, at least one of the raceway plugs 414 are positioned axially in front of the locking shoulders 304 (e.g., such that the raceway plugs 414 are proximate to the locking shoulders 304).

FIGS. 7E-7F depict completion of a second cycling stage. To achieve completion of the second cycling stage, the bolt 104 and the gas block 300 are simultaneously rotated (whether clockwise or counter-clockwise) away from the positional configuration shown in FIGS. 7C-7D. For example, the bolt 104 and the gas block 300 are rotated to new indexed positions (alternately positioned relative to the positional configuration shown in FIGS. 7C-7D). For instance, the bolt 104 and the gas block 300 are rotated clock-wise relative to the receiver 102 until positioned as shown in FIGS. 7E-7F.

To illustrate, at completion of the second cycling stage, the bolt 104 is positioned in a firing position where the bolt lugs 302 are axially in front of the locking shoulders 304 (as opposed to the raceway plugs 414 being so positioned in FIGS. 7C-7D). For instance, in the firing position, the bolt lugs 302 and the locking shoulders 304 are positioned in direct contact with each other. Accordingly, in the firing position, the bolt lugs 302 can support an axially applied load from recoil using the support of the locking shoulders 304 (thus maintaining the bolt 104 in place upon firearm discharge). Additionally, in the firing position, the bolt 104 is ready to impinge a firing pin (not shown) into a cartridge chambered in the barrel 106 for discharging the firearm.

In one or more embodiments, rotating the bolt 104 into the firing position includes maintaining an approximate axial position of the bolt 104 within the receiver 102 during the second cycling stage. That is, in some cases the bolt 104 may not proceed further frontward after achieving the position shown in FIGS. 7C-7D where the rear faces of the bolt lugs 302 become flush with the shoulder-interface portion 416. In certain implementations, the flush positioning of the bolt lugs 302 relative to the shoulder-interface portion 416 can help prevent gas flow rearward of the lug-interface plane 702.

Furthermore, the firing position of the bolt 104 coincides with a gas-blocking position of the gas block 300. In one or more embodiments, the gas-blocking position of the gas block 300 includes a position of the gas block 300 that substantially reduces any undesirable gas flow rearward of the lug-interface plane 702. Moreover, as shown in FIGS. 7E-7F, the gas-blocking position includes the raceway plugs 414 axially blocking at least part of the bolt-lug raceways 308 rearward of the lug-interface plane 702. In certain implementations, the raceway plugs 414 forms a hermetical seal with the shoulder-interface portion 416, thereby preventing rearward gas flow into the bolt-lug raceways 308. For example, the size, shape, and edge contours of the raceway plugs 414 are dimensioned to block the bolt-lug raceways 308.

Those of ordinary skill in the art will appreciate that the foregoing cycling stages can be modified. Additionally or alternatively, the foregoing cycling stages can be reversed (e.g., for opening the bolt 104 and removing a spent cartridge). In particular, the gas block 300 can be rotated away from the gas-blocking position (shown in FIGS. 7E-7F) and back toward the unlocked position shown in FIGS. 7C-7D. Subsequently, the bolt 104 can withdraw and slide away from the gas block 300.

Any of the features, components, and/or parts, including the arrangements and configurations thereof shown in FIGS. 7A-7F can be included, either alone or in any combination, in any of the other examples of devices, features, components, and parts shown in the other figures described herein. Likewise, any of the features, components, and/or parts, including the arrangements and configurations thereof shown and described with reference to the other figures can be included, either alone or in any combination, in the example of the devices, features, components, and parts shown in FIGS. 7A-7F.

Figure 8B:
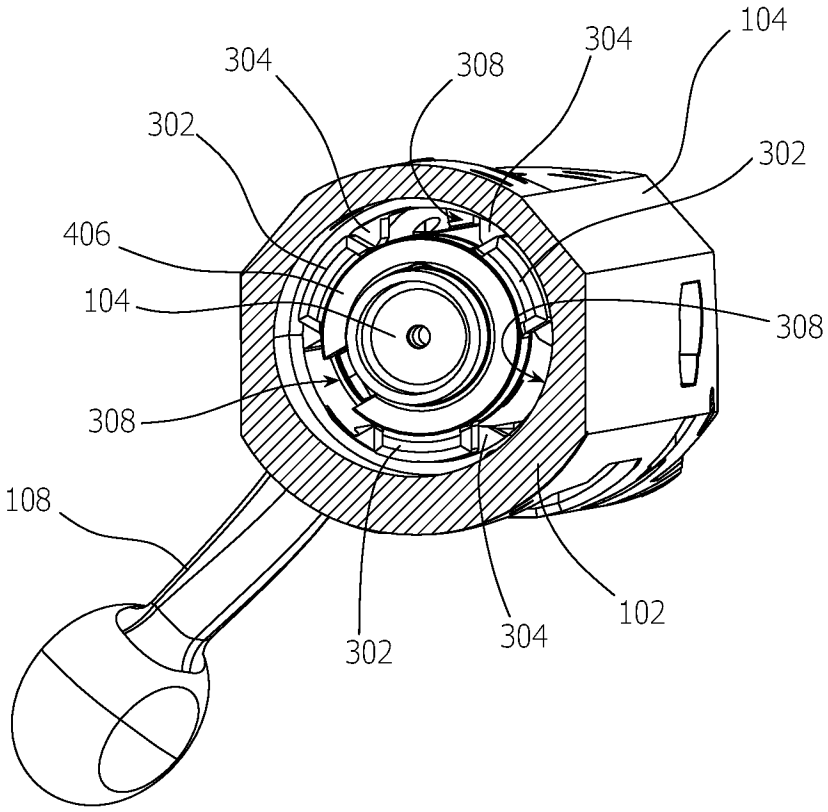
FIGS. 8A-8B illustrate front perspective section views of an example bolt positioned inside a receiver, with and without an example gas block, respectively.
Figure 8A:
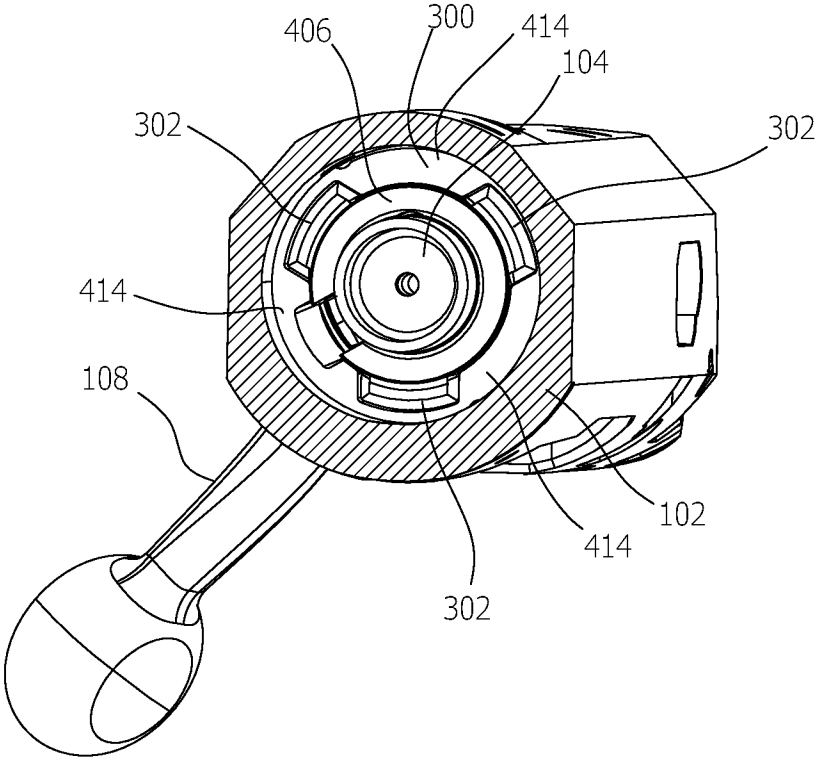

FIGS. 8A-8B illustrate front perspective section views of the bolt 104 positioned inside the receiver 102 in accordance with one or more embodiments. These views further illustrate concepts described above. In particular, FIG. 8A illustrates the gas block 300 positioned inside the receiver 102 and engaging the bolt lugs 302. As shown, the gas block 300 is positioned in a gas-blocking position—thereby axially blocking access to the bolt-lug raceways 308 rearward of the locking shoulders 304 (or the lug-interface plane 702 not shown). Specifically, the raceway plugs 414 are positioned at least partially in front of the bolt-lug raceways 308 as described above in relation to the foregoing figures.

FIG. 8B depicts a same position and orientation of the bolt 104 relative to the receiver 102 as shown in FIG. 8A. However, in FIG. 8B, the gas block 300 is hidden (or removed for illustrative purposes). In this hidden view, the bolt lugs 302 can be seen positioned in front of the locking shoulders 304 in the firing position (also described above). Furthermore, the bolt-lug raceways 308 rearward of the locking shoulders 304 are exposed (where the raceway plugs 414 would otherwise seal off). Thus, FIG. 8B shows (by way of omission) that the raceway plugs 414 of the gas block 300 can advantageously prevent gas flow rearward of the locking shoulders 304 when the gas block 300 is rotated into the gas-blocking position discussed above.

Any of the features, components, and/or parts, including the arrangements and configurations thereof shown in FIGS. 8A-8B can be included, either alone or in any combination, in any of the other examples of devices, features, components, and parts shown in the other figures described herein. Likewise, any of the features, components, and/or parts, including the arrangements and configurations thereof shown and described with reference to the other figures can be included, either alone or in any combination, in the example of the devices, features, components, and parts shown in FIGS. 8A-8B.

Figure 9A:
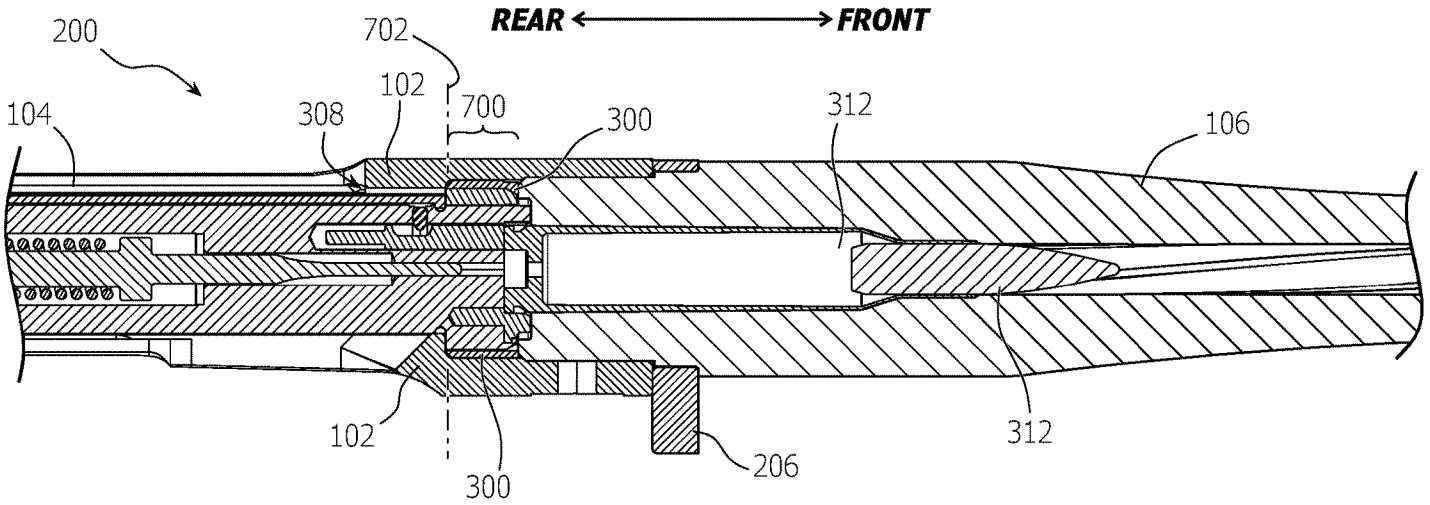
FIGS. 9A-9B illustrate side section and perspective side section views of an example firearm subassembly.
Figure 9B:
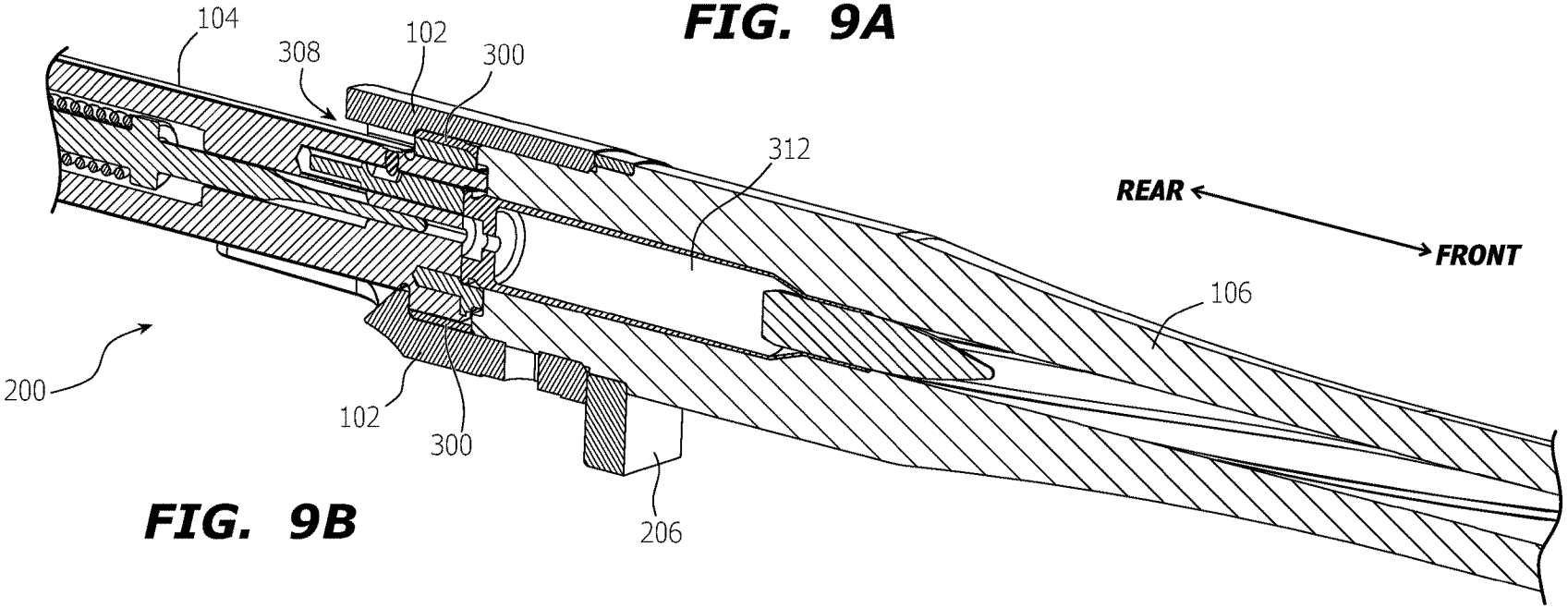

FIGS. 9A-9B illustrate side section and perspective side section views of the firearm subassembly 200 in accordance with one or more embodiments of the present disclosure. These views further illustrate the gas block 300 positioned within the lug-interface region 700. Furthermore, FIGS. 9A-9B illustrate the gas block 300 axially blocking the bolt-lug raceways 308 rearward of the lug-interface plane 702 (as described above in relation to the foregoing figures).

Further shown, the gas block 300 can fill an amount of space within the receiver 102 that would otherwise contribute to a total amount of volumetric void (non-occupied space) within the receiver 102. For example, the gas block 300 can substantially fill a volumetric void defined by the lug-interface region 700. As used herein, the term "substantially" means between 50% and 99%, between 60% and 90%, between 70% and 85%, or about 80% of the volumetric void within the lug-interface region 700 of the receiver 102.

Although FIGS. 9A-9B illustrate a particular configuration of various components, the present disclosure is not so limited. For instance, the lug-interface region 700 can alternatively be positioned in a barrel extension component (not shown). Within the lug-interface region 700 of a barrel extension, the gas block 300 can perform the same or similar functions as described above.

Any of the features, components, and/or parts, including the arrangements and configurations thereof shown in FIGS. 9A-9B can be included, either alone or in any combination, in any of the other examples of devices, features, components, and parts shown in the other figures described herein. Likewise, any of the features, components, and/or parts, including the arrangements and configurations thereof shown and described with reference to the other figures can be included, either alone or in any combination, in the example of the devices, features, components, and parts shown in FIGS. 9A-9B.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not target to be exhaustive or to limit the embodiments to the precise forms disclosed.

It will be apparent to one of ordinary skill in the art that many modifications and variations are possible in view of the above teachings. Indeed, various inventions have been described herein with reference to certain specific aspects and examples. However, they will be recognized by those skilled in the art that many variations are possible without departing from the scope and spirit of the inventions disclosed herein. Specifically, those inventions set forth in the claims below are intended to cover all variations and modifications of the inventions disclosed without departing from the spirit of the inventions. The terms "including" or "includes" as used in the specification shall have the same meaning as the term "comprising."

What is claimed is:

1. A firearm, comprising:
a locking shoulder;
a lug-interface region forward of the locking shoulder; and
a channel wall that defines a bolt channel and a bolt-lug raceway;
a bolt comprising a bolt lug, the bolt positioned within the bolt channel; and
a gas block positioned at the lug-interface region, the gas block being rotatable with the bolt lug, and the gas block comprising:
a raceway plug sized and shaped to block the bolt-lug raceway; and
a bolt-lug notch sized and shaped to engage the bolt lug.

2. The firearm of claim 1, further comprising a barrel connected to the receiver, wherein the lug-interface region is rearward of the barrel.

3. The firearm of claim 2, wherein the gas block is rotatably constrained at the lug-interface region, and the gas block comprises:
a first face proximate to the barrel; and
a second face opposing the first face, wherein:
the second face is adjacent to the locking shoulder; and
the raceway plug is positioned on the second face.

4. The firearm of claim 3, wherein the gas block comprises:
an annular exterior portion substantially perpendicular to the first face and the second face; and
a bolt-interface interior portion defining:
a thru-hole between the first face and the second face;
the bolt-lug notch;
the raceway plug; and
an extractor relief cutout.

5. The firearm of claim 1, wherein the bolt-lug notch is oriented toward the bolt-lug raceway for receiving the bolt lug during a first cycling stage.

6. The firearm of claim 1, wherein the bolt-lug notch is oriented toward the locking shoulder upon completion of a second cycling stage.

7. The firearm of claim 1, wherein the raceway plug is oriented toward the locking shoulder during a first cycling stage.

8. The firearm of claim 1, wherein the raceway plug is oriented toward the bolt-lug raceway upon completion of a second cycling stage.

9. The firearm of claim 8, wherein upon completion of the second cycling stage, the raceway plug forms at least a partial hermetical seal of the bolt-lug raceway.

10. The firearm of claim 1, wherein the gas block substantially fills a volumetric void defined by the lug-interface region.

11. A method of cycling a firearm, comprising:
providing a bolt, a gas block, a receiver, and a barrel connected to the receiver;
sliding, during a first cycling stage, the bolt through the receiver toward the barrel, the bolt comprising a bolt lug, and the receiver comprising a locking shoulder; and
rotating, during a second cycling stage, the bolt into a firing position upon the bolt reaching a lug-interface plane where a rear face of the bolt lug aligns flush with a front face of the locking shoulder, wherein:
rotating the bolt simultaneously rotates the gas block into a gas-blocking position; and
the gas-blocking position of the gas block substantially prevents gas escaping rearward of the lug-interface plane.

12. The method of claim 11, wherein:
the receiver comprises a bolt-lug raceway; and
sliding, during the first cycling stage, the bolt through the receiver comprises sliding the bolt lug forward in an axial direction along the bolt-lug raceway until a front face of the bolt lug is forward of the lug-interface plane.

13. The method of claim 11, wherein sliding, during the first cycling stage, the bolt through the receiver comprises sliding at least a portion of the bolt through the gas block.

14. The method of claim 11, further comprising mating the bolt lug and the gas block upon completion of the first cycling stage.

15. The method of claim 14, wherein upon completion of the first cycling stage:
the gas block comprises an abutment face proximate to the front face of the locking shoulder at the lug-interface plane, the abutment face comprising a raceway plug; and
mating the bolt lug and the gas block comprises aligning the rear face of the bolt lug approximately flush with the abutment face of the gas block.

16. The method of claim 15, wherein rotating, during the second cycling stage, the bolt into the firing position comprises:
rotating the gas block into the gas-blocking position by rotating the bolt lug and the gas block until the raceway plug axially blocks at least part of a raceway portion of the receiver rearward of the lug-interface plane.

17. A firearm, comprising:
a receiver comprising:
a locking shoulder;
a lug-interface region forward of the locking shoulder; and
a channel wall that defines a bolt channel and a bolt-lug raceway rearward of the locking shoulder;
a bolt comprising a bolt lug, the bolt positioned within the bolt channel of the receiver; and a gas block positioned at the lug-interface region, the gas block being rotatable with the bolt lug, and the gas block comprising:

a first face and a second face opposite the first face, the first face comprising a shoulder-interface portion;

an annular exterior portion substantially perpendicular to the first face and the second face; and a bolt-interface interior portion, the bolt-interface interior portion comprising:

a thru-hole between the first face and the second face; and a bolt-lug notch.

18. The gas ring insert of claim 17, wherein the second face comprises a barrel-facing portion.

19. The gas ring insert of claim 17, wherein the shoulder-interface portion comprises a raceway plug.

20. The gas ring insert of claim 17, wherein the annular exterior portion defines a recess sized and shaped to engage a detent.

* * * * *